US006597116B2

(12) United States Patent
Hendricx et al.

(10) Patent No.: US 6,597,116 B2
(45) Date of Patent: Jul. 22, 2003

(54) METAL HALIDE LAMP

(75) Inventors: Josephus Christiaan Maria Hendricx, Eindhoven (NL); Joseph Leonardus Gregorius Suijker, Turnhout (BE); Antonius Arnoldus Duisters, Eindhoven (NL); Fransiscus Arnoldus Vermeulen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 182 days.

(21) Appl. No.: 09/732,191

(22) Filed: Dec. 7, 2000

(65) Prior Publication Data

US 2001/0004191 A1 Jun. 21, 2001

(30) Foreign Application Priority Data

Dec. 9, 1999 (EP) ..... 99204222

(51) Int. Cl.[7] ..... H01J 61/18
(52) U.S. Cl. ..... 313/640; 313/641
(58) Field of Search ..... 313/640, 641, 313/642, 643, 637, 639, 630, 636, 638, 573; H01J 61/18

(56) References Cited

U.S. PATENT DOCUMENTS 5,075,587 A * 12/1991 Pabst et al. ..... 313/25
5,554,449 A * 9/1996 Tonomura et al. ..... 313/503
5,810,635 A * 9/1998 Heider et al. ..... 445/26
5,861,714 A * 1/1999 Wei et al. ..... 313/625
5,923,127 A * 7/1999 Keijser et al. ..... 315/224
5,965,984 A * 10/1999 Horiuchi et al. ..... 313/637
5,973,453 A * 10/1999 Van Vliet et al. ..... 313/623
6,137,230 A * 10/2000 Born et al. ..... 313/638
6,147,453 A * 11/2000 Geijtenbeek et al. ..... 313/640
6,300,729 B1 * 10/2001 Keijser et al. ..... 315/326
6,362,569 B1 * 3/2002 Wijenberg et al. ..... 313/634
6,362,571 B1 * 3/2002 Suijker et al. ..... 313/637

FOREIGN PATENT DOCUMENTS

EP 0377899 A2 12/1989 ..... H01J/61/12
WO WO 9928946 6/1999 ..... H01J/61/12

OTHER PUBLICATIONS

JP 10312771, "Discharge lamp and Image Projector Using Thereof", Feb. 1999, vol. 1999, No. 2, (Abstract).
JP 51086281A, Derwent Publication Ltd., AN 1976–69460X, XP002166172, (Abstract).

* cited by examiner

*Primary Examiner*—Don Wong
*Assistant Examiner*—Trinh Vo Dinh
(74) *Attorney, Agent, or Firm*—Frank Keegan

(57) ABSTRACT

Metal halide lamps are disclosed having a discharge vessel with a ceramic wall. The discharge vessel encloses a discharge space comprising an ionizable gas filling and, in addition to Hg, an alkali iodide of Na or Li or a combination of both. The filling also includes $TbI_3$ or $GdI_3$ or a combination thereof.

7 Claims, 1 Drawing Sheet

METAL HALIDE LAMP

FIELD OF THE INVENTION

The invention relates to a metal halide lamp comprising a discharge vessel having a ceramic wall, which discharge vessel encloses a discharge space comprising an ionizable filling which, in addition to Hg, comprises an alkali iodide of Na or Li or a combination thereof.

BACKGROUND OF THE INVENTION

A lamp of the type described in the opening paragraph is known from WO 99/28946-A1. The known lamp combines a high specific luminous flux with fairly good color properties (for example, a value of the general color-rendering index $R_a \geqq 60$ and a color temperature $T_c$ in the range of 3000 K and 6000 K).

In this lamp, use is made of the recognition that a good color rendition is possible when Na halide is used as a filling constituent of a lamp and when there is a strong broadening and reversal of the Na emission in the Na-D lines during lamp operation. This requires a high temperature of, for example 1170 K (900° C.) of the coldest spot $T_{kp}$ in the discharge vessel. When the Na-D lines are reversed and broadened, they take the form of an emission band in the spectrum, with two maxima at a mutual distance $\Delta\lambda$.

The requirement for a high value of $T_{kp}$ has the result that the discharge vessel is relatively small, which leads to a high temperature of the wall of the discharge vessel in the practical lamp. The required high temperature excludes the use of quartz or quartz glass for the wall of the discharge vessel and necessitates the use of ceramic material for the wall of this vessel.

In this description and the claims, a ceramic material wall is understood to mean both a wall of metal oxide such as, for example, sapphire or densely sintered polycrystalline $Al_2O_3$, and metal nitride, for example AlN.

The light emitted by the lamp has a color point with co-ordinates (x, y) which deviates from that of a blackbody. The mathematical collection of color points of blackbodies is referred to as the blackbody line (BBL). An application of the known lamp as a light source with a $T_c$ above 4700 K has the drawback that the color point of the lamp with co-ordinates x, y is more than 0.05 scale division above the BBL. Consequently, the known lamp is less suitable for use as, for example, a studio lamp.

SUMMARY OF THE INVENTION

It is an object of the invention to realize a lamp of the type described in the opening paragraph, in which the drawback described is eliminated.

According to the invention, a lamp of the type described in the opening paragraph is therefore characterized in that the filling of the discharge vessel also comprises $TbI_3$ or $GdI_3$ or a combination thereof.

A lamp according to the invention has the advantage that a value of the color temperature $T_c$ above 4700 K, preferably above 5000 K can be realized and that a general color-rendering index $R_a$ of at least 85 can be realized, while the lamp has a color point which is less than 0.02 above the BBL. The filling preferably comprises $TbI_3$ in a molar ratio of at least 5% and at most 45%. This contributes to a satisfactory stability of the color properties of the lamp during its lifetime. A similar advantage can be realized if the filling comprises $GdI_3$ in a molar ratio of at least 5% and at most 45%.

In a further embodiment, the filling comprises NaI and TlI. A lamp can then be obtained which emits light at a color temperature $T_c$ of between 5500 K and 7600 K and a general color-rendering index $R_a$ of between 85 and 96, with a relatively long lifetime and a relatively small decline of the luminous flux during the lifetime.

In a further embodiment of the lamp according to the invention, the filling comprises $CeI_3$ and $TbI_3$. A lamp can then be realized with a color temperature $T_c$ of between 4700 K and 7500 K and a relatively large luminous flux. To this end, the filling of the lamp preferably comprises NaI, $CeI_3$, $ErI_3$ and $TbI_3$. When the filling comprises $TbI_3$ in a molar ratio of at least 8% and at most 16%, this will contribute to the stability of the color temperature $T_c$ of the lamp during its lifetime. This also generally leads to a smaller shift of the color point of the lamp.

In a further variant, the filling of the lamp comprises LiI, $CeI_3$ and $TbI_3$, which results in a satisfactory stability of the color properties of the lamp in the case of different lamp positions.

The lamp according to the invention appears to be very suitable for use as a light source for, inter alia, video recordings for which a color temperature of more 4700 K, preferably above 5000 K is desired.

These and other aspects of the invention are apparent from and will be elucidated with reference to the embodiments described hereinafter.

DETAILED DESCRIPTION OF THE PREFERRED EMBODIMENTS

Figure 1:
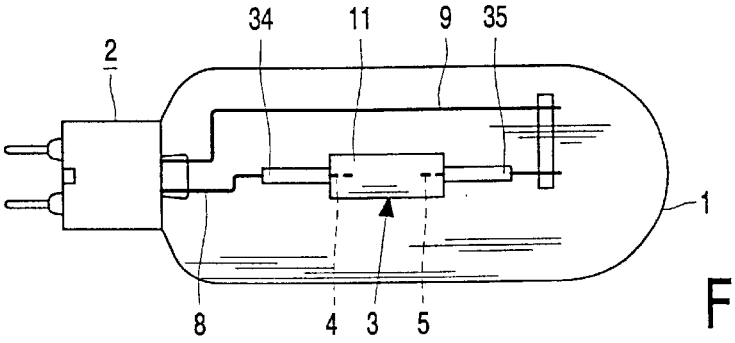
FIG. 1 shows a lamp according to the invention.
Figure 2:
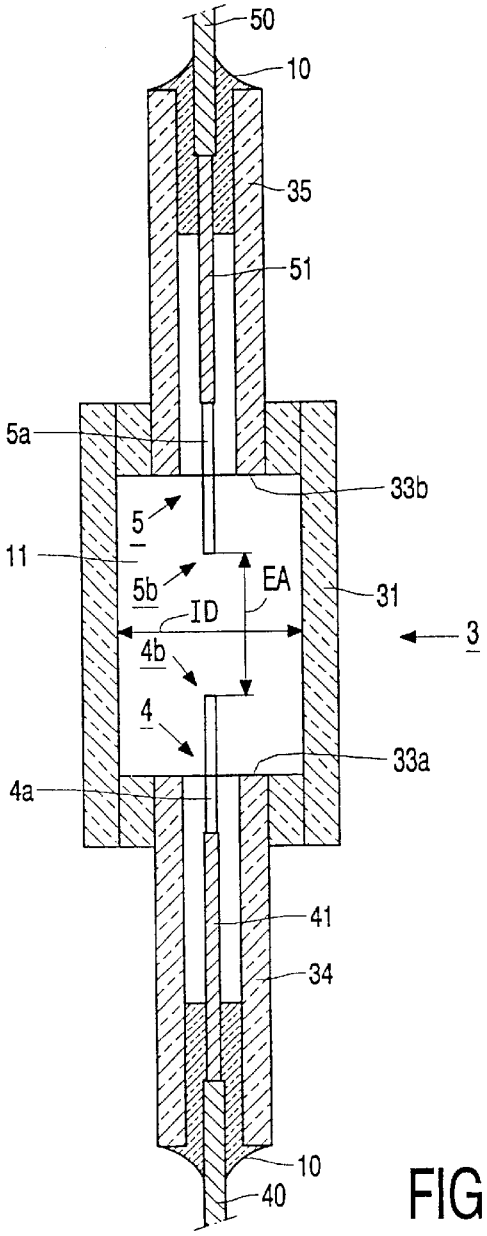
FIG. 2 is a cross-section of a discharge vessel of the lamp shown in FIG. 1.

FIG. 1 shows a metal halide lamp comprising a discharge vessel 3, which is not drawn to scale in a cross-section in FIG. 2, which discharge vessel has a ceramic wall enclosing a discharge space 11 comprising an ionizable filling which, in addition to Hg comprises an alkali iodide of Na or Li or a combination thereof. The filling of the discharge vessel also comprises $TbI_3$ or $GdI_3$ or a combination of both.

The discharge space accommodates two electrodes 4, 5, each of W in the drawing, with electrode bars 4*a*, 5*a* and with an electrode tip 4*b*, 5*b* spaced apart at a distance EA. The discharge vessel has a cylindrical part with an internal diameter ID, extending between end faces 33*a*, 33*b* and at least through the distance EA. The discharge space enclosed by the discharge vessel is sealed at the area of the end faces 33*a*, 33*b*.

The discharge vessel is sealed on one side by a ceramic extended plug 34, 35 which extends as far as the end face 33*a*, 33*b* and tightly encloses, with some interspace, a current feedthrough conductor 40, 41 and 50, 51, respectively to the electrodes 4, 5 arranged in the discharge vessel and is connected thereto in a gastight manner near one end remote from the discharge space by means of a melt-ceramic compound 10. The discharge vessel is enclosed by an outer envelope 1 which has a lamp base 2 at one end. In the operating condition of the lamp, a discharge extends between the electrodes 4 and 5. Electrode 4 is connected via a current conductor 8 to a first electric contact which forms part of the lamp base 2. Electrode 5 is connected via a current conductor 9 to a second electric contact which forms part of the lamp base 2.

A large number of practical realizations with mutually different filling constituents and different power were made of the lamp described above. In a first series, the filling of the discharge vessel comprised NaI, TlI and $TbI_3$. In a first variant, the iodide salts of the filling had a molar ratio of 49:13:38 and the total salt quantity was 7.1 mg. Such a lamp with a nominal power of 35 W had a specific light output of 59 lm/W corresponding to a wall load of 45 W/cm$^2$. The lamp emitted light at a color temperature $T_c$ of 7035 K and had a general color-rendering index $R_a$ of 92. The co-ordinates (x; y) of the color point were (0.306:0.315), a fraction below the BBL. After a lifetime of 1000 hours, the decline of the specific luminous flux was 8 lm/W. The color point which remained below the BBL moved towards the co-ordinates (0.320; 0.324) which corresponds to a $T_c$ of 6280 K. A similar lamp had a nominal power of 50 W, a wall load of 61 W/cm$^2$ and a specific luminous flux of 73 lm/W. The values for $T_c$ and $R_a$ were 5500 K and 95, respectively, and the color point co-ordinates were (0.332; 0.349), being 0.01 scale division above the BBL.

In the case of a lamp with a nominal power of 70 W and 150 W, the iodide salt filling had a molar ratio of 57:4:39. In the case of the lamp of 70 W, the salt filling had a mass of 6 mg and the values for $T_c$ and $R_a$ were 7511 K and 88, respectively, and its color point co-ordinates were (0.298; 0.318). The lamp had a specific luminous flux of 78 lm/W, showing a decline of about 20% after a lifetime of 2000 hours. In the lamp of 150 W, with a salt filling of 8.5 mg, the values for $T_c$ and $R_a$ were 6600 K and 96, respectively, and its color point co-ordinates were (0.310; 0.333). In this case, the value for the wall load was 59 W/cm$^2$. The lamp had a specific luminous flux of 74 lm/W. For both lamps, the color point was located about 0.01 scale division above the BBL. The lamp of 150 W reached a lifetime of more than 4000 hours. At 2000 hours, the specific luminous flux was 86% of the original value and 80% at 4000 hours. The color temperature $T_c$ had remained substantially constant after 2000 hours.

For the purpose of comparison, two lamps were made with an iodide salt filling of NaI, TlI and $GdI_3$ in a molar ratio of 72:4:24. For the lamp of 35 W, the salt filling had a mass of 5.95 mg and the values for $T_c$ and $R_a$ were 7380 K and 85, respectively, and the color point co-ordinates were (0.298; 0.326). The lamp had a specific luminous flux of 66.5 lm/W. For the lamp of 50 W, the wall load was 42 W/cm$^2$, and the values for $T_c$ and $R_a$ were 5880 K and 90, respectively, with color point co-ordinates (0.323; 0.351). The lamp had a specific luminous flux of 68 lm/W. The color point in both lamps was located less than 0.02 scale division above the BBL.

A second series of practical realizations of the lamp described was provided with a discharge vessel having an ionizable filling comprising, in addition to Hg, also NaI, $CeI_3$, $ErI_3$ and $TbI_3$. The Table below states some data of these lamps.

All lamps had a wall load of less than 62 W/cm$^2$. The specific luminous flux and the color temperature $T_c$ of lamp nos. 1, 2 and 3 decreased during the first 500 hours of their lifetime; for the specific luminous flux, the decrease ranged between 16% and 27% and for the color temperature $T_c$ between 700 K and 1200 K. However, for lamp 5, the specific luminous flux was still 80% of the original value and the color temperature $T_c$ had changed by less than 115 K after 1000 hours. Lamp 6 showed the same phenomena. In contrast, the color temperature $T_c$ of lamp 4 had decreased by more than 1200 K.

The influence of the operating position of the lamp on the color temperature $T_c$ was also examined for lamps 3, 4, 5 and 6. For the lamps with 16 mol % of $TbI_3$, the difference between the value of $T_c$ in the horizontal operating position and an operating position at an angle of 45° to the horizontal was 1250 K. For the lamps 5 and 6, this difference was 300 K. The shift of the color point of these lamps was also determined. The color point of lamp 3 had the co-ordinates (0.353; 0.377) after 500 hours, which is a shift of 0.03 and 0.05 scale division. The shift was 0.039 and 0.056 scale division for lamp 4 after 1000 hours. The color points of lamps 5 and 6 after 1000 hours were (0.355; 0.344) and (0.341; 0.327), respectively. The largest shifts of measured color points of lamps 5 and 6 during a lifetime of 1000 hours were smaller than 0.023, both in the x direction and in the y direction.

In a further practical realization of the lamp according to the invention, the filling of the discharge vessel was formed by Hg, 3.3 mg of $NaI+CeI_3+ErI_3+TbI_3$ in a molar ratio of 70:13:6:11, and 0.13 mg of $HgI_2$. The lamp, which had a nominal power of 35 W, had a specific luminous flux of 64 lm/W with a value of the color temperature $T_c$ and the color-rendering index $R_a$ of 6080 K and 82, respectively. The co-ordinates of the color point were (0.322; 0.318). After 1000 hours, the color point had the co-ordinates (0.335; 0.342). In both cases, the color point was about 0.015 scale division below the BBL. Under the influence of a change of the operating position of the lamp, there was a change of the color temperature of maximally 700 K. Under otherwise equal circumstances a relative increase of the molar quantity of $TbI_3$ led to a shift of the color point which was largely parallel to the BBL.

Finally, a lamp according to the invention was made in which, in addition to Hg, the ionizable filling of the discharge vessel comprised LiI, $CeI_3$ and $TbI_3$. The molar ratio of the iodide salts was 71:22:7 and the mass was 10 mg. The lamp had a nominal power of 70 W. The difference in value of the color temperature $T_c$ under the influence of the operating position of the lamp was less than 300 K. The values for the specific luminous flux, color temperature $T_c$, color-rendering index $R_a$ and color point co-ordinates in the

TABLE

| Lamp number | 1 | 2 | 3 | 4 | 5 | 6 |
|---|---|---|---|---|---|---|
| Nominal wattage (W) | 50 | 50 | 50 | 35 | 50 | 35 |
| Molar salt comp. Na:Ce:Er:Tb | 74:6:6:14 | 69:8:8:15 | 73:6:5:16 | 73:5:6:16 | 74:6:5:15 | 74:7:4:15 |
| Salt mass (mg) | 8 | 2 | 6 | 5 | 6 | 6 |
| Luminous flux (lm/W) | 69 | 76 | 74 | 61 | 71 | 70 |
| Color-rendering index $R_a$ | 93 | 93 | 93 | 90 | 93 | 87 |
| Color temperature $T_c$ (K) | 5300 | 7070 | 5870 | 6620 | 4825 | 5190 |
| Coordinates Color point | .337:.341 | .307:.307 | .325:.333 | .305:.290 | .350:351 | .339:.327 |

horizontal and vertical operating positions were 72.3 lm/W, 5200 K, 84, (0.342; 0.383) and 73.5 lm/W, 5435 K, 83 and (0.335; 0.371), respectively.

Due to their color properties and relatively low power, the practical embodiments described have proved to be very suitable for use as light sources in SSTV (studio, stage, television), video and film recording conditions. Another great advantage is a lifetime of 1000 hours or more.

The protective scope of the invention is not limited to the embodiments described. The invention resides in each and every novel characteristic feature and each and every combination of characteristic features. Reference numerals in the claims do not limit their protective scope. The use of the verb "to comprise" and its conjugations does not exclude the presence of elements other than those stated in the claims. The use of the indefinite article "a" or "an" preceding an element does not exclude the presence of a plurality of such elements.

What is claimed is:

1. A metal halide lamp comprising a discharge vessel having a ceramic wall, the discharge vessel enclosing a discharge space comprising an ionizable filling, said filling comprising, in addition to Hg, an iodide of Na or Li or a combination thereof, the filling of the discharge vessel further comprising $TbI_3$ or $GdI_3$ or a combination thereof, wherein the filling comprises $TbI_3$ in a molar ratio of at least 5% and at most 45%.

2. A metal halide lamp comprising a discharge vessel having a ceramic wall, the discharge vessel enclosing a discharge space comprising an ionizable filling, said filling comprising, in addition to Hg, an iodide of Na or Li or a combination thereof, the filling of the discharge vessel further comprising $TbI_3$ or $GdI_3$ or a combination thereof, wherein the filling comprises $CeI_3$ and $TbI_3$.

3. A metal halide lamp comprising a discharge vessel having a ceramic wall, the discharge vessel enclosing a discharge space comprising an ionizable filling, said filling comprising, in addition to Hg, an iodide of Na or Li or a combination thereof, $TbI_3$ or $GdI_3$ or a combination thereof, and further comprising NaI, $CeI_3$, $ErI_3$ and $TbI_3$.

4. The lamp claimed in claim 3, the filling comprising $TbI_3$ in a molar ratio of at least 8% and at most 16%.

5. A metal halide lamp comprising:

a discharge vessel having a ceramic wall, the discharge vessel enclosing a discharge space comprising an ionizable filling;

said ionizable filling comprising Hg, an iodide of Na or Li or a combination thereof;

the filling of the discharge vessel also comprising $TbI_3$ or $GdI_3$ or a combination of $TbI_3$ and $GdI_3$;

the filling further comprising LiI, $CeI_3$ and $TbI_3$.

6. A metal halide lamp comprising a discharge vessel having a wall and being operable at a temperature of the coldest spot in said discharge vessel of 900° C., said discharge vessel enclosing a discharge space containing an ionizable filling comprising mercury, an alkali iodide, said alkali iodide being sodium iodide, lithium iodide or a combination of sodium iodide and lithium iodide, and a rare earth iodide, said rare earth iodide being terbium iodide or gadolinium iodide or a combination of terbium iodide and gadolinium iodide, wherein the filling comprises $TbI_3$ in a molar ratio of at least 5% and at most 45%.

7. A metal halide lamp comprising a discharge vessel having a wall and being operable at a temperature of the coldest spot in said discharge vessel of 900° C., said discharge vessel enclosing a discharge space containing an ionizable filling comprising mercury, an alkali iodide, said alkali iodide being sodium iodide, lithium iodide or a combination of sodium iodide and lithium iodide, and a rare earth iodide, said rare earth iodide being terbium iodide or gadolinium iodide or a combination of terbium iodide and gadolinium iodide, wherein the filling comprises $CeI_3$ and $TbI_3$.

* * * * *